US009476378B2

(12) United States Patent
Lee

(10) Patent No.: US 9,476,378 B2
(45) Date of Patent: Oct. 25, 2016

(54) METHOD AND SYSTEM FOR DIAGNOSING COMMON RAIL DIESEL ENGINE

(71) Applicant: Hyundai Motor Company, Seoul (KR)

(72) Inventor: Tae Seong Lee, Gyunggi-Do (KR)

(73) Assignee: Hyundai Motor Company, Seoul (KR)

( * ) Notice: Subject to any disclaimer, the term of this patent is extended or adjusted under 35 U.S.C. 154(b) by 198 days.

(21) Appl. No.: 14/313,525

(22) Filed: Jun. 24, 2014

(65) Prior Publication Data

US 2015/0167572 A1 Jun. 18, 2015

(30) Foreign Application Priority Data

Dec. 18, 2013 (KR) ..... 10-2013-0157986

(51) Int. Cl.
*F02D 41/22* (2006.01)
*F02D 41/38* (2006.01)
*F02D 41/04* (2006.01)

(52) U.S. Cl.
CPC ..... *F02D 41/3809* (2013.01); *F02D 41/221* (2013.01); *F02D 41/042* (2013.01); *F02D 41/3836* (2013.01); *F02D 2041/225* (2013.01); *F02D 2200/0602* (2013.01)

(58) Field of Classification Search
CPC ..... F02D 41/3809; F02D 41/221; F02D 41/042; F02D 41/3836; F02D 2200/0602; F02D 2041/224; F02D 2041/225
USPC ..... 123/456, 457, 479, 510, 511; 701/103, 701/107; 73/114.38, 114.43
See application file for complete search history.

(56) References Cited

U.S. PATENT DOCUMENTS 6,012,438 A * 1/2000 Joos ..... F02D 41/1454 123/198 D
6,564,616 B2 * 5/2003 Antonioli ..... F02D 41/0085 73/114.38
7,278,405 B2 * 10/2007 Takahashi ..... F02D 41/221 123/447
8,806,927 B2 * 8/2014 Hofmeister ..... F02D 41/1497 73/114.43

FOREIGN PATENT DOCUMENTS

JP 2013-194718 A 9/2013
KR 2001-0104004 A 11/2001
KR 10-2008-0053553 A 6/2008

* cited by examiner

*Primary Examiner* — Hai Huynh
(74) *Attorney, Agent, or Firm* — Morgan, Lewis & Bockius LLP

(57) ABSTRACT

Disclosed are a method and a system for diagnosing a common rail diesel engine. The method for diagnosing a common rail diesel engine may include setting a time when a pressure of a common rail becomes a first set pressure to a diagnosis start time and neglecting a state of the common rail until the pressure of the common rail decreases from the first set pressure to a second set pressure which is a diagnosis end pressure, verifying a time when the pressure of the common rail becomes the second set pressure and determining the time as a diagnosis end time when the pressure of the common rail becomes the second set pressure, calculating a diagnosis time as an elapsed time from the diagnosis start time to the diagnose end time, and diagnosing that fuel leaks from the common rail when the diagnosis time is shorter than a diagnosis set time by comparing the diagnosis time with the diagnosis set time.

11 Claims, 4 Drawing Sheets

METHOD AND SYSTEM FOR DIAGNOSING COMMON RAIL DIESEL ENGINE

CROSS-REFERENCE TO RELATED APPLICATION

The present application claims priority of Korean Patent Application Number 10-2013-0157986 filed on Dec. 18, 2013, the entire contents of which application are incorporated herein for all purposes by this reference.

BACKGROUND OF INVENTION

1. Field of Invention

The present invention relates to a method and a system for diagnosing a common rail diesel engine that can sense and diagnose a fuel leak from a fuel supply system of the common rail diesel engine.

2. Description of Related Art

As is generally known, a common rail diesel engine is a scheme that directly injects fuel into a combustion chamber unlike an existing engine which is a scheme that supplies fuel and air to the combustion chamber through a mixer.

For example, a diesel fuel injecting device which has been used up to now is a scheme that uses a cam driving device in order to acquire injection pressure and has a principle in which the injection pressure increases together with an increase of velocity, and as a result, an injection fuel amount increases.

However, a common rail scheme according to the present invention has an advantage in that generation of injection pressure and an injection process are separated from each other such that pressure generation and injection of fuel may be separately considered in designing an engine, and as a result, combustion and injection processes may be freely designed.

That is, in the common rail diesel engine, since fuel pressure and a fuel injection time may be adjusted according to an engine operating condition by using an engine map, even when an rpm of the engine is low, high-pressure injection is enabled, and as a result, complete combustion may be pursued, exhaustion and noise may be minimized, and fuel efficiency may be significantly improved.

Referring to a configuration of a common rail diesel engine, fuel in a fuel tank 2 is pumped by a high-pressure fuel pump 4 and supplied to a common rail 6, as illustrated in FIG. 1. Fuel which is supplied to the common rail 6 while keeping predetermined pressure is injected into the combustion chamber through a fuel injector 8.

The high-pressure fuel pump 4 serves to pump fuel while being driven by a cam shaft and pressure in the common rail 6 is sensed by a pressure sensor 10. An engine control device 20 controls a pressure control valve 12, which is placed in an outlet of the high-pressure fuel pump 4, according to the rpm and a load of the engine, so as to continuously control fuel to a set value without compressing the fuel at high pressure while rotating the engine.

However, in the existing common rail diesel engine, when a small amount of fuel leaks from a common rail 10 and/or a connection rail, a change in pressure sensed by the pressure sensor 10 is slight, and as a result, there is a limit in diagnosing the fuel leak.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a method and a system for diagnosing a common rail diesel engine that may diagnose a leak or a minute leak of fuel in the common rail diesel engine through efficient logic to prevent a risk caused by leaking fuel and effectively decrease time, cost, and the like required for diagnosis/repairing.

Various aspects of the present invention provide a method for diagnosing a common rail diesel engine including: determining whether a diagnosis request signal for requesting a diagnosis of the common rail diesel engine is input while the common rail diesel engine is driven; increasing a pressure of a common rail to a set pressure if the diagnosis request signal is input; stopping the common rail diesel engine and neglecting the common rail diesel engine when the pressure of the common rail increases to the set pressure and until the pressure of the common rail decreases to a first set pressure which is a diagnosis start pressure; setting a time when the pressure of the common rail becomes the first set pressure to a diagnosis start time and neglecting a state of the common rail until the pressure of the common rail decreases from the first set pressure to a second set pressure which is a diagnosis end pressure; verifying a time when the pressure of the common rail becomes the second set pressure and determining the time as a diagnosis end time when the pressure of the common rail becomes the second set pressure; calculating a diagnosis time as an elapsed time from the diagnosis start time to the diagnose end time; and diagnosing that fuel leaks from the common rail when the diagnosis time is shorter than a diagnosis set time by comparing the diagnosis time with the diagnosis set time.

A state in which the common rail diesel engine is driven may be an idle state. The diagnosis request signal may be output from external engine diagnosis equipment. The set pressure of the common rail may be the maximum pressure of the common rail. The method may further include generating an alert when it is diagnosed that the fuel leaks from the common rail.

Various other aspects of the present invention provide a system for diagnosing a common rail diesel engine including: a high-pressure fuel pump configured to set fuel of a diesel engine at high pressure; a pressure control valve configured to control a pressure of fuel output from the high-pressure fuel pump; an injector configured to inject the high-pressure fuel into a combustion chamber of the diesel engine; a common rail configured to supply the high-pressure fuel into the injector; a pressure sensor configured to detect a pressure of the common rail; an engine control unit (ECU) configured to control the common rail diesel engine; and a diagnoser configured to diagnose a fuel leak from the common rail, in which the diagnoser operates by a program set for performing the method for diagnosing a common rail diesel engine of the present invention.

The system may further include an alerter configured to generate an alert when it is diagnosed that fuel leaks from the common rail.

According to various aspects of the present invention, a leak or a minute leak of fuel is detected and/or diagnosed in the common rail diesel engine through efficient logic to prevent a risk caused by leaking fuel and effectively decrease time, cost, and the like required for diagnosis/repairing.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
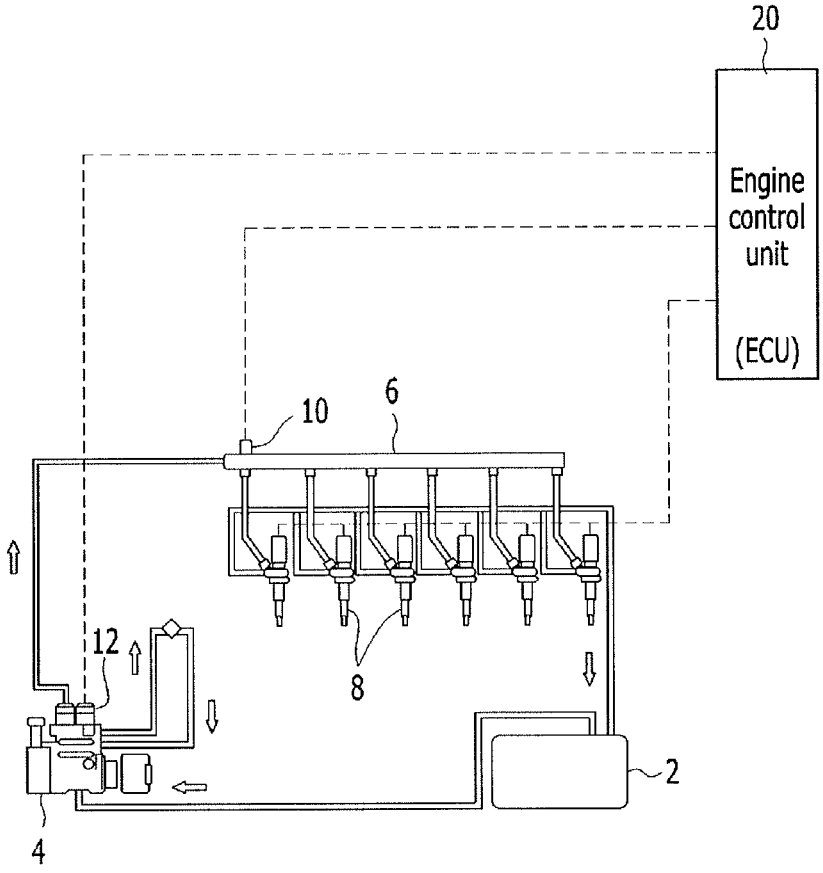
FIG. 1 (Related Art)
FIG. 1 is a schematic configuration diagram of a general common rail diesel engine.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In addition, in the specification, unless explicitly described to the contrary, the word "comprise" and variations such as "comprises" or "comprising", will be understood to imply the inclusion of stated elements but not the exclusion of any other elements. Like reference numerals designate like elements throughout the specification.

Figure 2:
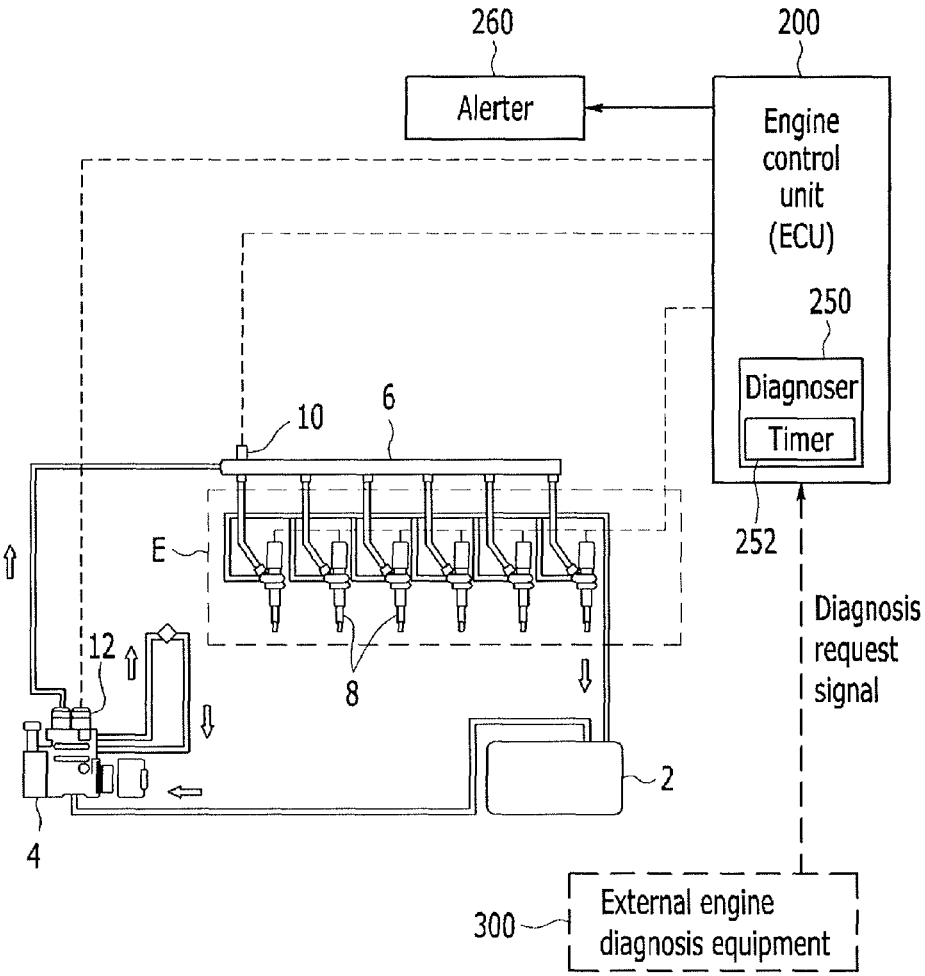
FIG. 2 is a configuration diagram of an exemplary system for diagnosing a common rail diesel engine according to the present invention.

FIG. 2 is a configuration diagram of a system for diagnosing a common rail diesel engine according to various embodiments of the present invention. The system for diagnosing a common rail diesel engine according to various embodiments of the present invention is a system that monitors a pressure decrease in a common rail and diagnoses a fuel leak failure in the common rail based on the monitored pressure decrease.

The system for diagnosing a common rail diesel engine according to various embodiments of the present invention may include: a high-pressure fuel pump 4 for keeping fuel of a diesel engine E at high pressure; a pressure control valve 12 for controlling pressure of fuel output from the high-pressure fuel pump 4; an injector 8 for injecting high-pressure fuel into a combustion chamber of the diesel engine E; a common rail 6 for supplying the high-pressure fuel into the injector 8; a pressure sensor 10 for detecting pressure of the common rail 6; an engine control unit (ECU) 200 for controlling the common rail diesel engine E; a diagnoser 250 for diagnosing a fuel leak from the common rail 6; and an alerter 260 for generating an alert when it is diagnosed that the fuel leaks from the common rail 6.

As the high-pressure fuel pump 4, the pressure control valve 12, the injector 8, the common rail 6, and the pressure sensor 10, devices used in the related art may be used and a detailed description thereof will be omitted in the specification.

Except that the ECU 200 interacts with the diagnoser 250 to be described below, the ECU 200 may correspond to the existing ECU 20 of FIG. 1.

The diagnoser 250 is hardware including one or more microprocessors and/or microprocessors that operate by a set program, and the set program may be formed of a series of commands for performing a method for diagnosing a common rail diesel engine according to various embodiments of the present invention, which is to be described below.

The diagnoser 250 may be included in the ECU 200 as shown in FIG. 2. In some embodiments, the diagnoser 250 may be independently configured. The diagnoser 250 may include a timer 252 for counting and/or measuring a time.

Hereinafter, a method for diagnosing a common rail diesel engine according to various embodiments of the present invention will be described in detail with reference to the accompanying drawings.

Figure 3:
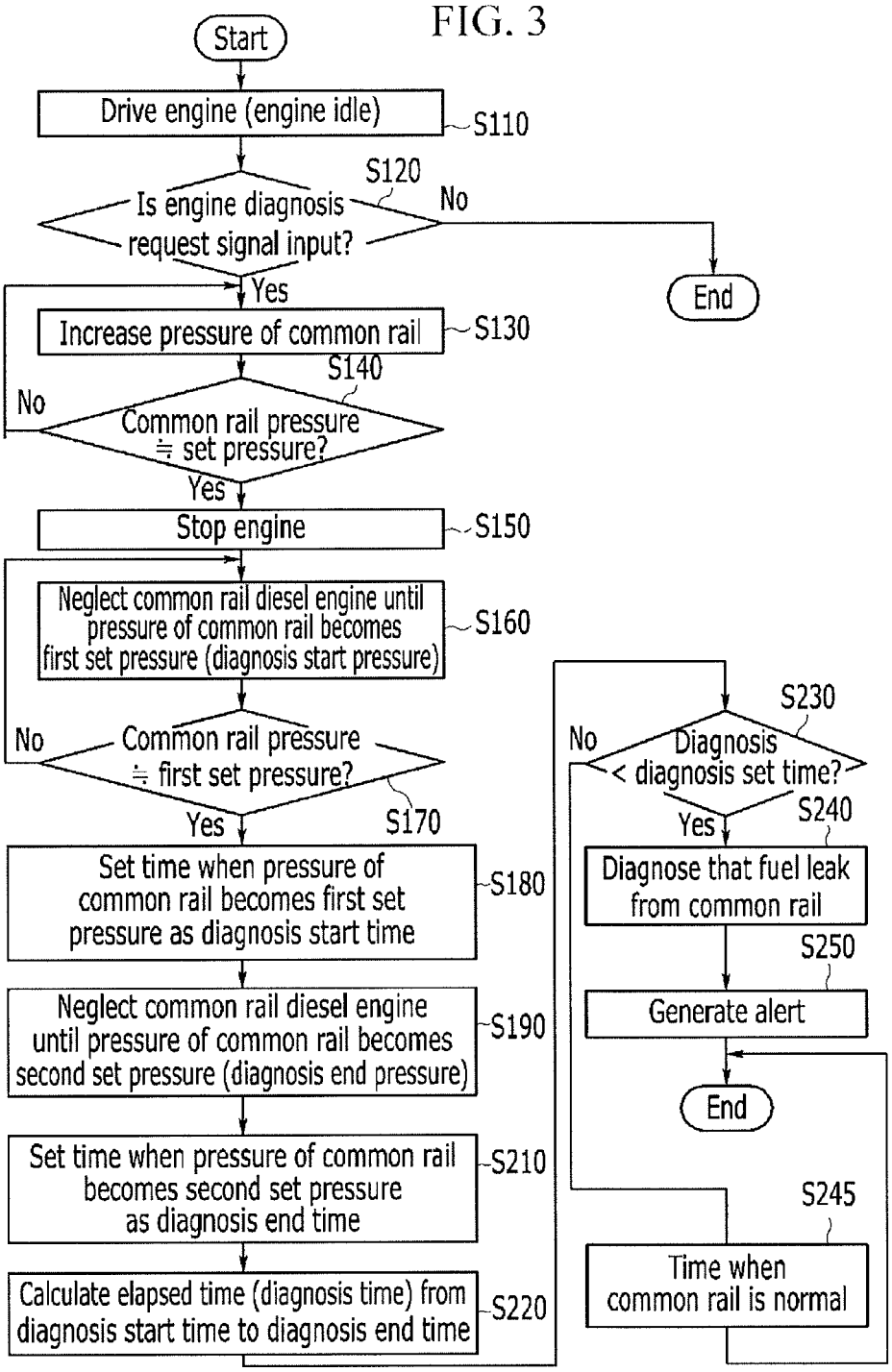
FIG. 3 is a flowchart of an exemplary method for diagnosing a common rail diesel engine according to the present invention.

FIG. 3 is a flowchart illustrating a method for diagnosing a common rail diesel engine according to various embodiments of the present invention. As illustrated in FIG. 3, the diagnoser 250 verifies whether the common rail diesel engine E is in a driving state, for example, in an idle state (S110).

Whether the common rail diesel engine E is in the idle driving state may be easily verified or determined through the existing technology.

When the common rail diesel engine E is in the idle driving state, the diagnoser 250 determines whether a diagnosis request signal for requesting a diagnosis of the common rail diesel engine E is input (S120). The diagnosis request signal may be, for example, a signal output from engine diagnosis equipment 300 for diagnosing the common rail diesel engine outside.

Figure 4:
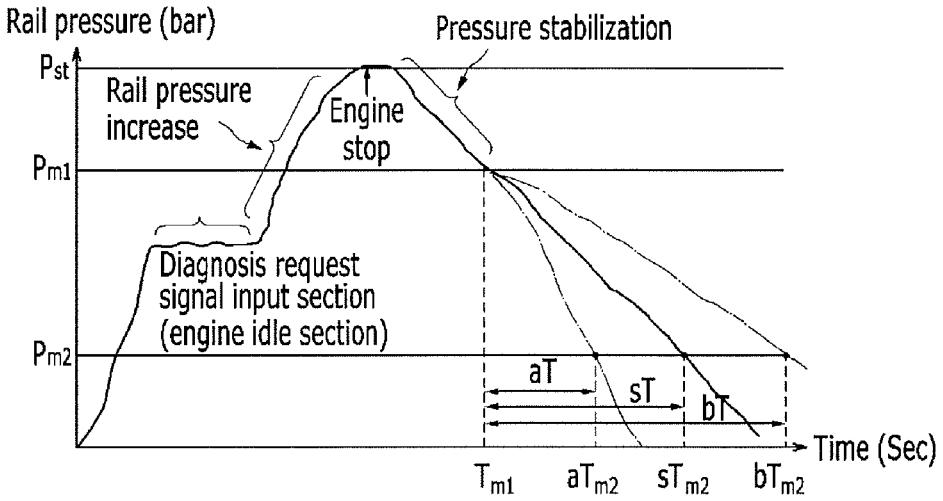
FIG. 4 is a graph for describing an operation of an exemplary method and an exemplary system for diagnosing a common rail diesel engine according to the present invention.

When the diagnosis request signal is input, the diagnoser 250 increases the pressure of the common rail 6 to set pressure Pst (e.g., highest pressure) as illustrated in FIG. 4 (S130). The highest pressure may be highest pressure defined in a specification of the common rail 6.

The diagnoser 250 may control the high-pressure fuel pump 4 through the ECU 200 to increase the pressure of the common rail 6 and detect the pressure of the common rail 6 through the pressure sensor 10.

When the pressure of the common rail 6 increases and thereafter, increases to the set pressure Pst, the diagnoser 250 stops the common rail diesel engine E through the ECU 200 (S150) and maintains an engine stop state until the pressure of the common rail 6 decreases to first set pressure Pm1 (diagnosis start pressure) (e.g., approximately 80% of the highest pressure) (S160). The diagnosis start pressure Pm1 may be variously set according to a characteristic of the engine by considering a design aspect.

When the pressure of the common rail 6 reaches the first set pressure Pm1 (S170), the diagnoser 250 sets a time when the pressure of the common rail 6 becomes the first set pressure Pm1 to a diagnosis start time Tm1 by using the timer 252 (S180) and keeps a state of the common rail 6 as it is until the first set pressure Pm1 decreases to second set pressure Pm2 (diagnosis end pressure) (e.g., approximately 30% of the highest pressure) (S190).

When the pressure of the common rail 6 becomes the second set pressure Pm2, a time when the pressure of the common rail 6 becomes the second set pressure Pm2 is verified through the timer 252 and the time is determined as a diagnosis end time aTm2 or bTm2 (S210).

In FIG. 4, it may be known that the diagnosis end time aTm2 is earlier than the other diagnosis end time bTm2.

When the diagnosis end time is determined as described above, the diagnoser 250 calculates a diagnosis time aT or bT as an elapsed time from the diagnosis start time Tm1 to the diagnosis end time aTm2 or bTm2 (S220).

When the diagnosis time is calculated, the diagnoser 250 compares the diagnosis time with a diagnosis reference set time sT (S230). The diagnosis reference set time sT may be set by verifying a time when the pressure of the common rail 6 normally decreases through an experiment and/or design specification.

In step S230, as a result of the comparison, when the diagnosis time aTm2 is shorter than the diagnosis reference set time sT, this case means that the fuel leaks from the common rail, and as a result, the diagnoser 250 diagnoses that the fuel leaks from the common rail, which corresponds thereto (S240) and if not, for example, in the case where the diagnosis time is aTm2, the diagnoser 250 diagnoses that the common rail is normal, which corresponds thereto (S245).

As described in step S240, when it is diagnosed that the fuel leaks from the common rail 6, the diagnoser 250 generates an alert through the alerter 260 controlled by the ECU 200 so as to allow a driver and/or a user to recognize that the fuel leaks from the common rail 6 (S250).

Therefore, according to the exemplary embodiments of the present invention, a minute leak of fuel in the common rail diesel engine may be diagnosed through efficient logic.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for diagnosing a common rail diesel engine, comprising:

determining by a diagnoser, whether a diagnosis request signal for requesting a diagnosis of the common rail diesel engine is input while the common rail diesel engine is driven;

increasing by the diagnoser, a pressure of a common rail by controlling a high-pressure fuel pump through an engine control unit (ECU) to a set pressure if the diagnosis request signal is input;

stopping by the diagnoser, the common rail diesel engine through the ECU and neglecting the common rail diesel engine when the pressure of the common rail detected through a pressure sensor increases to the set pressure and until the pressure of the common rail decreases to a first set pressure which is a diagnosis start pressure;

setting by the diagnoser, a time when the pressure of the common rail becomes the first set pressure to a diagnosis start time by using a timer and neglecting a state of the common rail until the pressure of the common rail detected through the pressure sensor decreases from the first set pressure to a second set pressure which is a diagnosis end pressure;

verifying by the diagnoser, a time when the pressure of the common rail becomes the second set pressure and determining the time by using the timer as a diagnosis end time when the pressure of the common rail becomes the second set pressure;

calculating by the diagnoser, a diagnosis time as an elapsed time from the diagnosis start time to the diagnose end time; and diagnosing by the diagnoser, that fuel leaks from the common rail when the diagnosis time is shorter than a diagnosis set time by comparing the diagnosis time with the diagnosis set time.

2. The method of claim 1, wherein:

a state in which the common rail diesel engine is driven is an idle state.

3. A system for diagnosing a common rail diesel engine, comprising:

the diagnoser operates by a program set for performing the method of claim 2;

the high-pressure fuel pump configured to set fuel of a diesel engine at a high pressure;

a pressure control valve configured to control a pressure of fuel output from the high-pressure fuel pump;

an injector configured to inject high-pressure fuel into a combustion chamber of the diesel engine;

the common rail configured to supply the high-pressure fuel into the injector;

the pressure sensor configured to detect a pressure of the common rail;

the engine control unit (ECU) configured to control the common rail diesel engine; and the diagnoser configured to diagnose a fuel leak from the common rail.

4. The method of claim 1, wherein:

the diagnosis request signal is output from an external engine diagnosis equipment.

5. A system for diagnosing a common rail diesel engine, comprising:

the diagnoser operated by a program set for performing the method of claim 4 the high-pressure fuel pump configured to set fuel of a diesel engine at a high pressure;

a pressure control valve configured to control a pressure of fuel output from the high-pressure fuel pump;

an injector configured to inject high-pressure fuel into a combustion chamber of the diesel engine;

the common rail configured to supply the high-pressure fuel into the injector;

the pressure sensor configured to detect a pressure of the common rail;

the engine control unit (ECU) configured to control the common rail diesel engine; and the diagnoser configured to diagnose a fuel leak from the common rail.

6. The method of claim 1, wherein:

the set pressure of the common rail is a maximum pressure of the common rail.

7. A system for diagnosing a common rail diesel engine, comprising:

the diagnoser operated by a program set for performing the method of claim 6;

the high-pressure fuel pump configured to set fuel of a diesel engine at a high pressure;

a pressure control valve configured to control a pressure of fuel output from the high-pressure fuel pump;

an injector configured to inject the high-pressure fuel into a combustion chamber of the diesel engine;

the common rail configured to supply the high-pressure fuel into the injector;

the pressure sensor configured to detect a pressure of the common rail;

the engine control unit (ECU) configured to control the common rail diesel engine; and the diagnoser configured to diagnose a fuel leak from the common rail.

8. The method of claim 1, further comprising:

generating an alert when it is diagnosed that the fuel leaks from the common rail.

9. A system for diagnosing a common rail diesel engine, comprising:

the diagnoser operates by a program set for performing the method of claim 8 the high-pressure fuel pump configured to set fuel of a diesel engine at a high pressure;

a pressure control valve configured to control a pressure of fuel output from the high-pressure fuel pump;

an injector configured to inject the high-pressure fuel into a combustion chamber of the diesel engine;

the common rail configured to supply the high-pressure fuel into the injector;

the pressure sensor configured to detect a pressure of the common rail;

the engine control unit (ECU) configured to control the common rail diesel engine; and the diagnoser configured to diagnose a fuel leak from the common rail.

10. A system for diagnosing a common rail diesel engine, comprising:

the diagnoser operated by a program set for performing the method of claim 1;

the high-pressure fuel pump configured to set fuel of a diesel engine at a high pressure;

a pressure control valve configured to control a pressure of fuel output from the high-pressure fuel pump;

an injector configured to inject high-pressure fuel into a combustion chamber of the diesel engine;

the common rail configured to supply the high-pressure fuel into the injector;

the pressure sensor configured to detect a pressure of the common rail;

the engine control unit (ECU) configured to control the common rail diesel engine; and the diagnoser configured to diagnose a fuel leak from the common rail.

11. The system of claim 10, further comprising:

an alerter configured to generate an alert when it is diagnosed that the fuel leaks from the common rail.

* * * * *